United States Patent [19]

Franks, Jr.

[11] Patent Number: 4,657,092

[45] Date of Patent: Apr. 14, 1987

[54] CIRCULATION REVERSING TOOL

[75] Inventor: Robert L. Franks, Jr., Lake Charles, La.

[73] Assignee: J & F Oil Tools, Inc., Beaumount, Tex.

[21] Appl. No.: 755,909

[22] Filed: Jul. 17, 1985

[51] Int. Cl.[4] ..... E21B 21/00

[52] U.S. Cl. ..... 175/232; 175/317; 175/321; 175/324

[58] Field of Search ..... 175/215, 231, 232, 317, 175/321, 324, 393, 400; 137/625.31

[56] References Cited

U.S. PATENT DOCUMENTS

| | | | |
|---|---|---|---|
| 2,075,064 | 3/1937 | Schumacher et al. | 175/231 |
| 3,365,007 | 1/1968 | Skipper | 175/231 |
| 3,743,035 | 7/1973 | Tiraspolsky | 175/317 |
| 3,804,186 | 4/1974 | Schoeffler | 175/317 |
| 3,823,788 | 7/1974 | Garrison et al. | 175/215 |

FOREIGN PATENT DOCUMENTS

| | | | |
|---|---|---|---|
| 2029873 | 3/1980 | United Kingdom | 175/232 |

*Primary Examiner*—James A. Leppink
*Assistant Examiner*—Hoang C. Dang
*Attorney, Agent, or Firm*—Breneman, Georges, Hellwege & Yee

[57] ABSTRACT

A transformable circulation tool for reversing the path of drilling fluid at the drill bit without removing the drill string from the borehole annulus is provided by a substantially hollow body having a chamber with external ports disposed between a section of the body having a through passage and a by-pass passage in combination with a diverter mounted on a telescoping member having means for engaging the body during drilling and disengaging the body for rotation of the diverter with respect to each of the passages. A seal is rotatably mounted to the substantially hollow body between the ports to divide the well borehole into an upper conventional flow portion and a lower portion where the flow of the drilling fluid can be reversed upon command from the surface.

34 Claims, 28 Drawing Figures

CIRCULATION REVERSING TOOL

BACKGROUND OF THE INVENTION

1. Field of the Invention

The present invention pertains to a circulation reversing tool for reversing the flow of drilling fluid in a well borehole at the nozzles of an oil well tool such as a drill bit. More particularly, the invention relates to a novel circulation reversing tool which upon a predetermined command will provide either a conventional circulation system in which drilling fluid travels down inside the drill string through the nozzles of the drill bit and back up the annulus, or which will reverse the circulation of the drilling fluid at a predetermined point along the drill string to result in drilling fluid flowing down the borehole annulus and into the nozzles of the drill bit and up the inside of the drill string to the predetermined point in the drill string without removing the drill string or circulation reversing tool from the well borehole. The circulation above the predetermined point on the drill string remains conventional notwithstanding changes in circulation below the predetermined point which changes in circulation do not interfere with drilling operations.

The circulation reversing tool includes a body divided into upper and lower portions in which the lower portion includes internal passages connecting the borehole annulus with the interior of the tool above and below a seal that is rotatably mounted on the body of the tool. The body of the tool includes a telescoping member threaded into the drill string having a rotatable diverter to alternatively engage the internal passages in the body to provide a conventional circulation pattern at a point above the seal and alternatively provide either a conventional or reverse circulation pattern below the seal upon command from the surface. The circulation reversing tool provides numerous advantages over prior art reverse circulation tools and allows drilling to be converted from conventional circulation to reverse circulation without removing the drill string from the borehole to increase the rate of removal of cuttings from the well faster and increase drill bit life while eliminating the problems of down time in trips to change the tool. The novel circulation reversing tool provides advantages in cleaning the borehole walls and in isolating producing zones in existing wells while drilling and providing numerous advantages heretofore unavailable in the prior art.

1. Description of the Prior Art

The prior art includes a variety of oil well tools for modifying the flow characteristics of the drilling fluid above the drill bit. A number of these prior art devices pertain to modifying the angular flow or velocity of drilling fluid above or around the drill bit while some tools are designed specifically to provide a complete reverse circulation system. A few prior art systems as described in patents such as Marais U.S. Pat. No. 4,223,747 and Franks, Jr. U.S. Pat. Nos. 4,285,408 and 4,312,415 pertain to reverse circulation tools designed to change the circulation of the drilling fluid above the drill bit in the borehole annulus. The prior art reverse circulation tool systems pertain to devices which when placed on the drill string convert a conventional or traditional flow system, in which drilling fluid goes down the interior of the drill string and out through the nozzles of the drill bit and up the borehole annulus, to a reverse circulation system at a point below the addition of the reverse circulation tool.

These prior art reverse circulation tools change the circulation path below the tool by diverting drilling fluid or mud from the interior of the drill string to the borehole annulus below the tool so that drilling fluid travels down the borehole annulus and in the nozzles of the drill bit and up the interior of the drill string to the reverse circulation tool and then exits through the sides of the drilling tool and up the borehole annulus above the reverse circulation tool. The best available known prior art reverse circulation tools require the removal of the entire drill string from the borehole annulus along with the circulation reversing tool and the subsequent disassembly of the tool in order to convert the system from a conventional to a reverse circulation system or back again. The requirement for the removal of the drill string and tool from the borehole annulus limits the advantages in converting from conventional to reverse circulation particularly in instances where the drill bit is stuck.

These limitations in the known prior art reverse circulation tools results in a change in circulation only during a trip or the removal of the drill string from the borehole annulus. The reverse circulation tools such as Franks, Jr. U.S. Pat. Nos. 4,285,408 and 4,312,415 allow a change from conventional to reverse circulation below the point of installation of the tool while maintaining traditional circulation above the tool. Such prior art reverse circulation tools like the ones previously discussed require the removal of the drill string from the borehole and disassembly of the tool to mechanically realign the ports to change conventional circulation to a reverse circulation system. This interruption in drilling required to remove and rack the drill string and then subsequently reconnect and replace the drill string back in the borehole limits the advantages of reverse circulation and is particularly apparent in cases where the drill bit becomes stuck.

Reversing circulation of drilling fluid at the drill bit while maintaining conventional circulation at a point above the drill bit provides numerous advantages during drilling including imparting a longer drill bit life by providing a more efficient circulation pattern and reducing the weight of the drilling collars to relieve pressure on the drill bit. Other advantages include a reduction in the fluid pump pressure, providing greater volume of drilling fluid to allow more footage to be made with less trip time in removing the drill pipe from the well borehole and reducing the number of changes of the bit.

These and other known advantages to reverse circulation however are in many cases offset by the limitations in prior art reverse circulation tools which require the removal of the entire drill string and tool from the borehole annulus to change from a conventional to a reverse circulation drilling system. The disadvantages and limitations of the prior art reverse circulation systems and in some cases the special equipment or tools required to remove or change the reverse circulation tool has limited the acceptance of such tools in modern high speed drilling operations which attempt to reduce the number of trips and down time required to remove the drill string from the borehole annulus. The cost and expense of rig time is often offset against the loss and cost of drill bits as a result of the time required to remove the drill string and rack drill pipe, which is usually 30 feet in length, to change over from conventional circulation to reverse circulation.

The present invention, unlike the prior art, provides a circulation reversing tool which upon a command from the surface changes from conventional circulation to reverse circulation and back again from reverse circulation to conventional circulation. The novel tool of the invention allows repeated changes in circulation without removing the drill string or drill bit from the borehole annulus thereby eliminating the time and expense required to remove, rack and mechanically change the most advanced prior art reverse circulation tools to change from a conventional circulation pattern to a reverse circulation pattern. The circulation reversing tool of the invention is furthermore compatible with both a conventional and reverse circulation system to provide the advantages of modifying the circulation flow pattern at the drill bit without removing the drill string. These and other features of the invention are particularly advantageous in freeing a drill bit that may become stuck during drilling operations. Unlike the prior art, the novel circulation reversing tool of the invention allows a change in circulation upon command from the surface without removing the drill string and without significant interruption of the drilling operation.

SUMMARY OF THE INVENTION

The disadvantages and limitations of the prior art reverse circulation systems and tools including the problem of removing the entire drill string in order to convert from a conventional circulation system to a reverse circulation system at the drill bit is obviated by the present transformable circulation tool. The novel transformable circulation tool of the invention allows circulation to be modified from conventional circulation to reverse circulation and back again upon command from the surface without significant interruption of the flow of drilling fluid or disruption to the drilling operation.

The novel circulation reversing tool allows circulation to be modified repeatedly from conventional to reverse circulation at the drill bit by a command from the surface which conveniently may be mechanical and include merely lifting the drill string and rotating the drill string in a reverse (counterclockwise) direction to provide reverse circulation and thereafter lowering the drill string to engage the splines in the tool for drilling in the traditional clockwise direction. Thereafter a change in reverse circulation to conventional circulation may be achieved by lifting the drill string and rotating the drill string in a forward (clockwise) direction to provide conventional circulation and lowering the drill string to engage the splines for continuing to drill in the clockwise direction.

The advantages of the circulation reversing tool of the invention are achieved by the utilization of a tool having a body with a chamber having one or more first ports through the wall of the tool connecting the inside of the tool to the exterior and at least one by-pass passage terminating in one or more second ports axially displaced from the first ports. The body also includes at least one through passage connecting the chamber with the interior of the tool below the body which body is threadably engaged to the lower portion of the drill string. The circulation reversing tool includes a telescoping member having at its upper end threads for threadable engagement to the upper portion of the drill string. The telescoping member includes a diverter attached to its lower end and rotatable in the chamber of the body for alternatively connecting the by-pass passage and the through passage with the interior of the upper portion of the drill string. The novel circulation reversing tool preferrably includes a seal rotatably disposed on the body between the first ports in the chamber and the axially displaced second ports.

The rotation of the diverter with respect to the through passage and by-pass passage in the body can be accomplished with gears, splines or guides and may be activated mechanically or electromechanically without removing the drill bit from the borehole annulus. In the preferred application of the invention, the rotation of the telescoping member along with the diverter to change the circulation at the drill bit is achieved by a combination of internal splines and guide on the body with corresponding splines and stops on the telescoping member which splines are disengaged by momentarily lifting the drill string, rotating the drill string clockwise for conventional circulation or counterclockwise for reverse circulation and then placing the weight back on the drill string to engage the splines before continuing drilling.

The momentary lifting of the weight on the drill string disengages the splines on the telescoping member and body and engages the alignment guide against one of the stops so that rotation of the drill string results in the alignment guide contacting the other stop which also aligns the splines and the diverter with respect to the other passage to change the circulation from a traditional circulation to reverse circulation at the drill bit. Once one of the stops contacts the alignment guide further rotation of the diverter with respect to the main tool body and passages is prevented and the lowering of the drill string results in the engagement of the splines on the telescoping member with the internal splines on body to provide a strong and dependable system generally desired to accommodate the torque forces in drilling.

The lifting of the drill string requires only a momentary interruption of the drilling operation. The reverse (counterclockwise) rotation of the diverter with respect to the body opens the by-pass passage and second ports to allow drilling fluid to reverse its circulation with respect to the drill bit while maintaining a conventional circulation pattern above the seal thereby eliminating the requirement for special tools and systems required for a complete reverse circulation system and the necessity of removing the drill string from the borehole annulus.

The circulation reversing advantages of the tool of the invention is enhanced by the seal rotatably mounted with respect to the body. The seal is preferably of a finned rubber construction mounted on a sleeve which is rotatably journalled to the body of the tool and is designed to snuggly fit against the wall of the borehole annulus. The seal serves to segment the borehole annulus into a conventional flow system above the seal and a convertable flow system below the seal.

The circulation reversing tool of the invention provides the advantages of modifying circulation at the drill bit to reduce wear of the drill bit, allows drilling to take place with less weight on the drill bit and provides great advantages in modifying the circulation of drilling fluid in the event the drill bit should become stuck in the borehole. The circulation reversing tool, provides additional advantages in milling operations in removing steel cuttings from the bit area and the drill hole and allows greater volumes of drilling fluid to be circulated at the drill bit to increase the removal of cuttings from the well faster and allow the bit to cut more freely particularly in instances where the drill bit encounters numerous changes in rock formation and drilling conditions. These advantages increase bit life and allow more footage to be drilled without the down time and work required to remove the drill string from the well borehole.

The invention reduces the number of trips, increases the drill bit life and provides increased and modifiable circulation patterns at the drill bit to assist in chip removal and reduce strain and forces on the drill bit. Moreover, as a consequence of its design and construction, the novel circulation reversing tool of the invention is conveniently manufactured and readily applied in the field to change circulation patterns at the drill bit to increase the life and efficiency of the drill bit.

DESCRIPTION OF THE DRAWINGS

Other advantages of the invention will become apparent to those skilled in the art from the following detailed description of the invention in conjunction with the accompanying drawings in which.

DETAILED DESCRIPTION OF THE INVENTION

Figure 1:
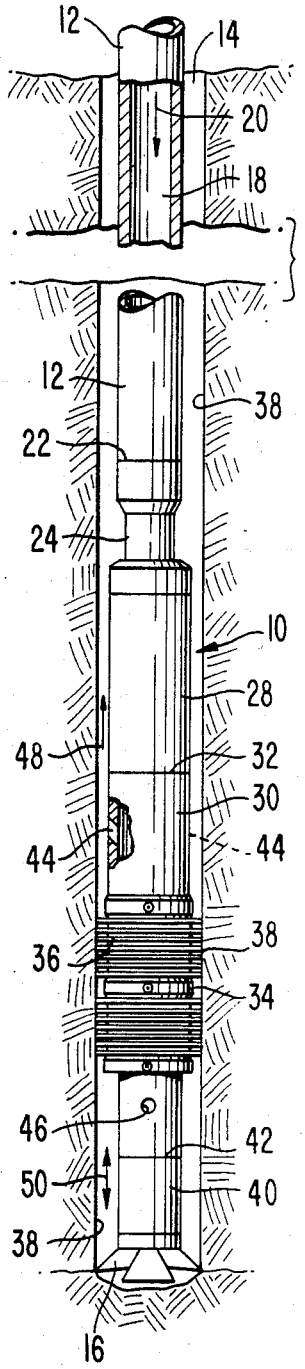
FIG. 1 is a side elevational view partly in section of a circulation reversing tool constructed in accordance with one embodiment of the invention connected to a drill string including a drill bit in a well borehole.
Figure 2:
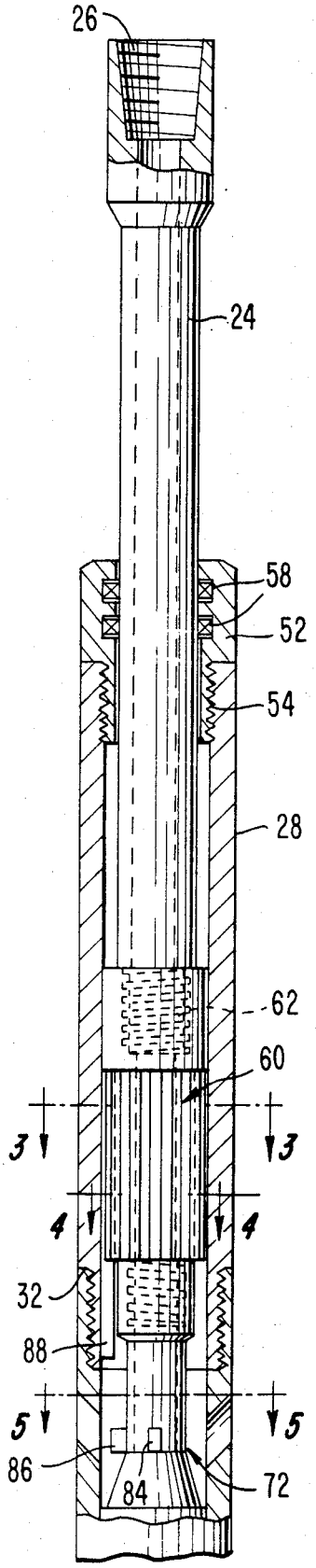
FIG. 2 is a side elevational view partly in section of an upper portion of the circulation reversing tool of FIG. 1.
Figure 6:
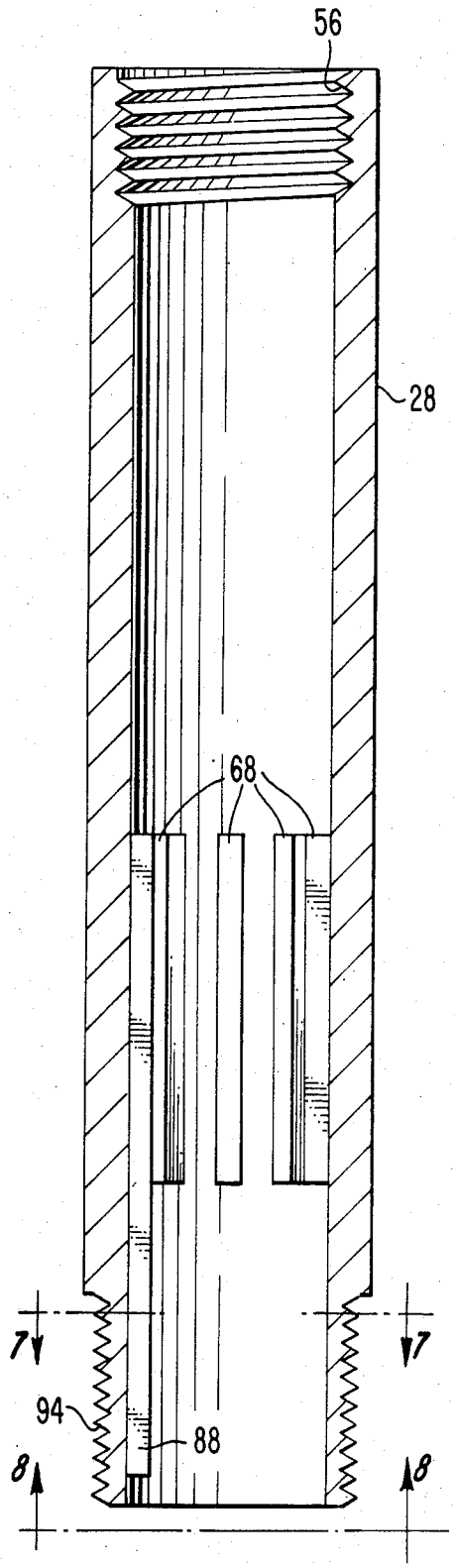
FIG. 6 is an elevational view in cross section of the upper portion of the body of the circulation reversing tool.

The circulation reversing tool of the invention allows the circulation of drilling fluid to be changed from conventional to reverse circulation at the drill bit without removing the drill string from the borehole and without significantly interrupting drilling operations. The novel transformable circulation tool is advantageously used with conventional drilling equipment which directs drilling fluid or mud down the center of the drill string and up the borehole annulus. The novel circulation reversing tool accommodates the conventional equipment and flow of drilling fluid in the drill string and borehole annulus above the installation of the tool while providing a convertible system from below the tool to the drill bit. The circulation reversing tool enables the system upon command from the surface to repeatedly convert from conventional flow to reverse flow without the necessity of removing and stacking drill string and removing the drilling bit from the borehole.

The advantages in converting from conventional flow to reverse flow without removing the tool from the well borehole include providing assistance in dislodging stuck drill bits, providing a greater and more efficient chip and rock removal and preferred flow characteristics of drilling fluid in the borehole to reduce hydrostatic pressure at the bottom of the hole while increasing the bit life and reducing the possibility of the bit becomming lodged or stuck in varying rock formations. These advantages of the novel circulation reversing tool of the invention are achieved without the necessity for removing the drill string and tool from the borehole annulus.

The repeated conversion from conventional to reverse circulation can be made without significantly disrupting drilling operations to provide a more efficient system which contributes to drill bit life and increases the amount of footage of hole that can be drilled during the drilling operation. The advantages of the circulation reversing tool of the invention for changing circulation at the drill bit while maintaining conventional flow above the tool are achieved in the preferred embodiment by the utilization of a tool having a body with a chamber having external ports and at least one by-pass passage with a port and at least one through passage in combination with a telescoping member having a diverter rotatably mounted with respect to the body and a latching mechanism for selectively aligning and fixing the position of the diverter with respect to the by-pass passage or the through passage.

The novel circulation reversing tool includes a seal journalled to the body between the external ports of the chamber and the by-pass ports. The seal is designed to slideably engage the walls of the borehole annulus and travel down the borehole as footage is drilled and to segment the borehole into an upper segment above seal in which the circulation is conventional and a lower segment in which the circulation can be converted from conventional to reverse upon command from the surface.

The alignment of the diverter with the by-pass passage or the through passage provides conventional circulation or reverse circulation at the drill bit. The tool in the preferred embodiment includes a latching mechanism of mating splines for locking and driving the drill string. The advantages of the latching mechanism in combination with the seal provides a convertible circulation system below the seal which will be described in accordance with the preferred embodiment of the invention and the best mode contemplated for providing a circulation reversing tool activated by a command from the surface.

Referring now to FIGS. 1–17 a circulation reversing tool 10 constructed in accordance with the preferred embodiment of the invention is illustrated. The circulation reversing tool 10 is illustrated in FIG. 1 in association with a drill string 12 in a well borehole 14 including a conventional drill bit 16 disposed at the end of the drill string 12. Drill string 12 and the associated drill pipe, kelly and derick are of a conventional type used in the modern rotary drilling art. Drill string 12 includes a standard hollow interior 18 for transporting drilling fluid down the center of the drill string in the direction of arrow 20 to tool 10. Tool 10 which is threadably connected to drill string 12 at connection 22 which connects member 24 to drill string 12 by threads 26 disposed in the member 24 of the circulation reversing tool 10.

Circulation reversing tool 10 includes a body conveniently segmented into an upper portion 28 which is connected to a lower portion 30 at connection 32. Lower portion 30 includes a sleeve 34 which preferably includes a finned rubber seal 36 designed to slideably contact walls 38 of the borehole annulus and rotatably mounted to portion 30. The lower portion 30 is connected at its lower end to a short section of pipe 40 at connection 42 to join the drill string 12 to drill bit 16. Section of pipe 40 is preferably a short section of pipe but may be long or include additional sub assemblies as may be added to the drill string to provide logging or other features known in oil well drilling technology.

In accordance with the preferred embodiment of the invention lower portion 30 includes a pair of first ports 44 disposed above seal 36 and a pair of second ports 46 disposed below the seal 36. Ports 44 in combination with the novel arrangement of components in the circulation reversing tool assures a traditional circulation flow of drilling fluid from the borehole annulus down to seal 36 by maintaining the flow of drilling fluid in the direction of arrow 20 down to circulation reversing tool 10 and an upward flow of drilling fluid in the direction of arrow 48 above seal 36 in the borehole annulus.

The novel circulation reversing tool changes the circulation flow of drilling fluid from conventional to reverse circulation from ports 46 down to the drilling nozzles in the drill bit 16 without the necessity of removing drill bit 16 from the well or significantly interrupting drilling operations. The path of drilling fluid from ports 46 to the drilling nozzles in drill bit 16 can be in either direction in the borehole annulus as illustrated by arrow 50 and as will be described hereinafter in greater detail.

Referring now to FIGS. 2–11 the preferred embodiment of the novel circulation reversing tool and the latching mechanism for engaging and driving the drill string and changing the flow of drilling fluid between the nozzles of drill bit 16 and ports 46 without removing the bit from the borehole will be described in greater detail. Member 24 is slideably and rotatably mounted in upper portion 28 by a closure 52 having threads 54 for engaging corresponding threads 56 (FIG. 6) at the top of upper portion 28. Closure 52 preferably includes a pair of seals 58 for slideably and rotatably sealing member 24 in upper portion 28.

Figure 3:
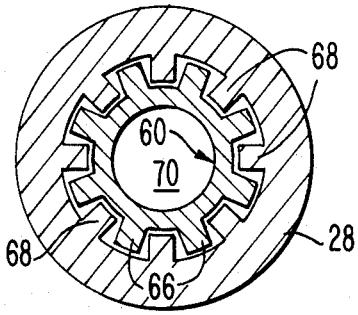
FIG. 3 is a cross sectional view of the circulation reversing tool of FIG. 2 taken along the line 3—3.
Figure 8:
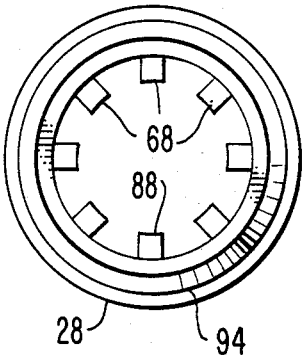
FIG. 8 is a cross sectional view of the upper portion of the body of the circulation reversing tool taken along the line 8—8 of FIG. 6.
Figure 9:
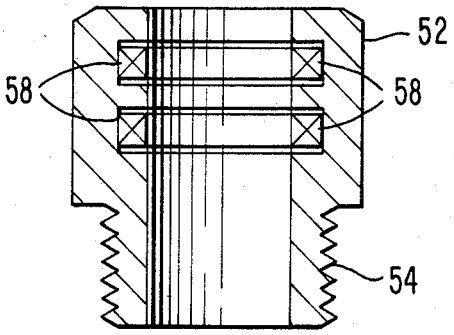
FIG. 9 is a cross section elevational view of the closure cap of the upper portion of the body of the circulation reversing tool.

Member 24 is preferably designed to threadably engage a splined section 60 (FIGS. 2 and 10) by threads 62 on member 24 and corresponding threads 64 on splined section 60. Splined section 60 includes a sufficient number of splines 66 to engage and drive a corresponding set of internal splines 68 in upper portion 28 to allow the entire drill string and tool to transmit the torque forces necessary to rotate circulation reversing tool 10 and drill bit 16. Splined section 60 includes a hollow center 70 (FIG. 4) for receiving drilling fluid from the interior of member 24 and in the drilling mode is designed to engage splines 68 in the wall of upper portion 28 as shown in FIG. 3.

The lower end of splined section 60 is connected to a Y-shaped diverter 72 by threads 74 on splined section 60 and internal threads 76 on diverter 72. Y-shaped diverter 72 includes a hollow center 78 for receiving drilling fluid from splined section 60 and diverting fluid through the Y-shaped diverted to a divided flow by the formation of channels 80 and 82. Y-shaped diverter 72 includes a pair of stops 84 and 86 disposed at about 90° to each other for rotatably positioning the Y-shaped diverter with respect to a spline key 88 which extends axially below splines 68 in portion 28.

Splines 66 on splined section 60 and internal splines 68 in upper portion 28 are arranged to cooperate with spline key 88 and stop 84 and 86 so that when member 24 is axially extended by raising the drill strings 12 to disengage splines 66 and 68, member 24 and diverter 72 can rotate together until either stop 84 or 86 contacts spline key 88 to thereby realign channels 80 and 82 and splines 66 and 68 with respect to two corresponding passages in the lower body to change the direction of flow. The momentary lifting and rotation of the diverter with respect to the spline key 88 results in a change in the circulation of drilling fluid between ports 46 and the drilling nozzles in the drill bit 16.

The contacting of stop 84 or 86 with spline key 88 prevents further rotation of member 24 and diverter 72 with respect to upper portion 28 and realigns splines 66 and 68 to the next successive position so that lowering the drill string on member 24 results in the re-engagement of splines 66 and 68 in the next successive position to drive the drill string in drilling and allows either stop 84 or 86 to slide down spline key 88. Thereafter a subsequent raising of member 24 allows splines 66 and 68 to disengage and once again rotate diverter 72 with respect to corresponding passages in the lower portion 30 as will be described hereinafter in greater detail.

Preferably spline key 88 and stop 84 and 86 are arranged so that disengagement of splines 66 and 68 and rotation of the drill string in a forward (clockwise) direction will result in the alignment of the diverter 72 with through passages to provide conventional circulation and a reverse (counterclockwise) rotation of the drill string will result in the alignment of channels 80 and 82 with by-pass passages in lower portion 30 to provide reverse circulation.

Diverter 72 includes a V-shaped notch 90 for providing channels 80 and 82 for alignment with corresponding through and by-pass passages in lower portion 30.

Referring now to FIGS. 1 and 6 to 15, the relationship between the upper portion 28 and Y-shaped diverter 72 for changing the position of the diverter with respect to the lower portion 30 for changing the direction of the circulation of drilling fluid between ports 46 and the nozzles in drilling bit 16 will be described in greater detail. Upper portion 28 is connected to lower portion 30 at connection 32 by threads 94 disposed on the lower end of upper portion 28 for engaging corresponding internal threads 96 on lower portion 30.

Lower portion 30 includes a chamber 98 for housing end 100 of Y-shaped diverter 72. Channels 80 and 82 of Y-shaped diverter 72 are designed to alternatively engage through passages 102 or by-pass passages 104 by the raising and lowering of member 24 in combination with stop 84 and 86 in combination with splined key 88. Flat confronting surface 108 of chamber 98 in combination with the flat confronting surfaces 106 of Y-shaped diverter 72 are designed to confront and seal either by-pass passages 104 with channels 80 and 82 of the Y-shaped diverter 72 or through passages 102 with channels 80 and 82 of the Y-shaped diverter 72.

Chamber 98 is designed to accommodate the rotation of Y-shaped diverter 72 and alternatively receive or transport drilling fluid from by-pass passages 104 or through passages 102. Chamber 98 communicates with a first pair of ports 44 and with by-pass passages 104 and through passages 102. By-pass passages 104 terminates in a pair of second ports 46 axially displaced from chamber 98 along lower portion 30. Chamber 98 in the operative mode alternatively communicates with either by-pass passages 104 or through passages 102 depending upon the position of Y-shaped diverter 72.

Lower portion 30 is designed so that through passages 102 interconnect the hollow interior 18 of the drill string 12 with member 24 and hollow center 70 of splined section 60 with channels 80 and 82 of Y-shaped diverter 72 and outlet 110 at the threaded lower end 112 of the lower portion 30. The connection of lower portion 30 by threaded lower end 112 to pipe 40 provides a through passage of drilling fluid down to the nozzles in drill bit 16 to result in a conventional flow of drilling fluid down through the novel circulation reversing tool. The Y-shaped diverter 72 when engaging through passages 102 results in drilling fluid entering ports 46 and being transported through by-pass passages 104 to chamber 98 to result in a conventional flow of drilling fluid both above seal 36 and below seal 36.

The rotation of Y shaped diverter 72 to engage by-pass passages 104 results in drilling fluid being forced down by-pass passages 104 and exiting ports 46 into the borehole annulus below seal 36 and down the borehole annulus to the nozzles of the drill bit 16. The drilling fluid enters the nozzles of the drill bit 16 and goes up the center of the pipe 40 and into outlet 110 up through passages 102 and into chamber 98 and out of ports 44 above the seal 36 to provide a reverse circulation of drilling fluid below seal 36 with respect to nozzles in the drill bit 16.

Figure 16:
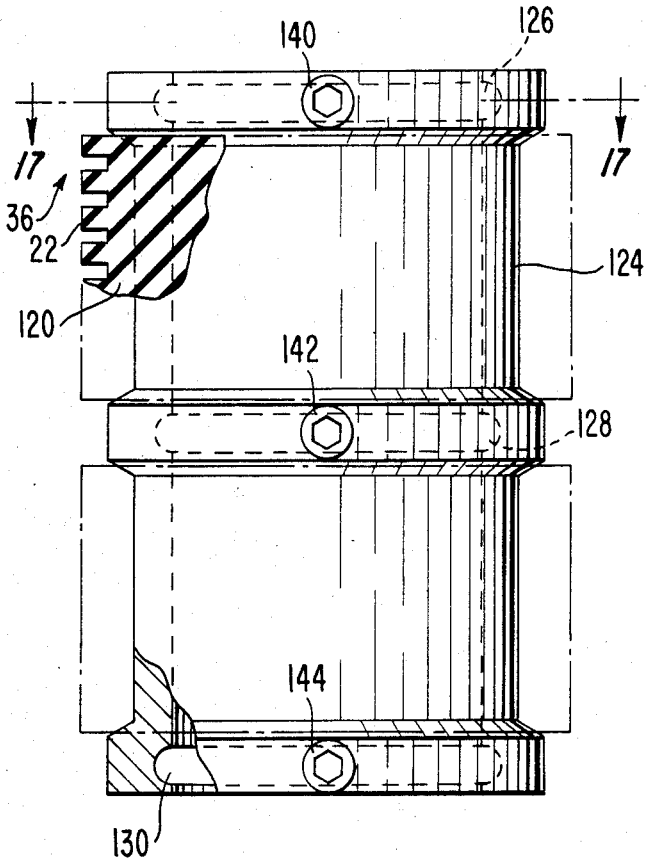
FIG. 16 is an elevational view partly in section of the seal and mounting sleeve.
Figure 17:
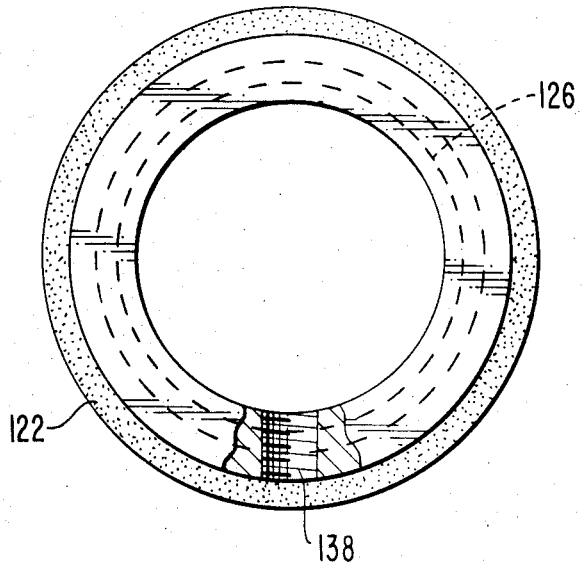
FIG. 17 is a cross sectional view of the seal and mounting sleeve taken along the line 17—17 of FIG. 16.

The lower portion 30, upper portion 28 and member 24 in drilling all rotate with the drill string 12 along with drill bit 16. The seal 36 rotatably mounted on lower portion 30 and is designed to remain stationary with respect to circulation reversing tool 10 and drill string 12 while moving axially down the well borehole with respect to the borehole annulus as footage progresses. The seal 36 in the preferred embodiment as shown in FIG. 1 and FIG. 16 includes one or more rubber sections 120 preferably including fins 122 for engaging the walls of the borehole annulus. Rubber sections 120 preferably include fins 122 for axial movement up and down the borehole annulus walls 38 while maintaining a division between the traditional circulation pattern above the seal 36 and the transformable circulation pattern from conventional to reverse and reverse to conventional below the seal 36.

The rubber sections 120 are preferably mounted on a sleeve 124 (FIG. 16) having three races 126, 128 and 130 for alignment with corresponding races 132, 134 and 136 on lower portion 30. Sleeve 124 may conveniently include openings 138 for receiving ball bearings (not shown) for the races provided by the 126–132 and 128–134, and 130–136 race combination when sleeve 124 is journalled to lower portion 30. Closure bolts 140, 142 and 144 may be conveniently used to close the ball bearings in the races to rotatably maintain sleeve 124 and seal 36 with respect to the novel circulation reversing tool 10.

Referring now to FIGS. 18–27 an application of the novel circulation reversing tool is illustrated for redrilling producing wells without having to cement producing perforations in the borehole annulus. The application of the present invention includes the utilization of two seals to isolate the producing zones in combination while maintaining traditional flow above the first seal and providing the advantages of a transformable circulation pattern below the second seal. The application of multiple seals on the novel circulation reversing tool provides advantages in isolating zones in existing wells or providing new and useful drilling operations.

Figure 18:
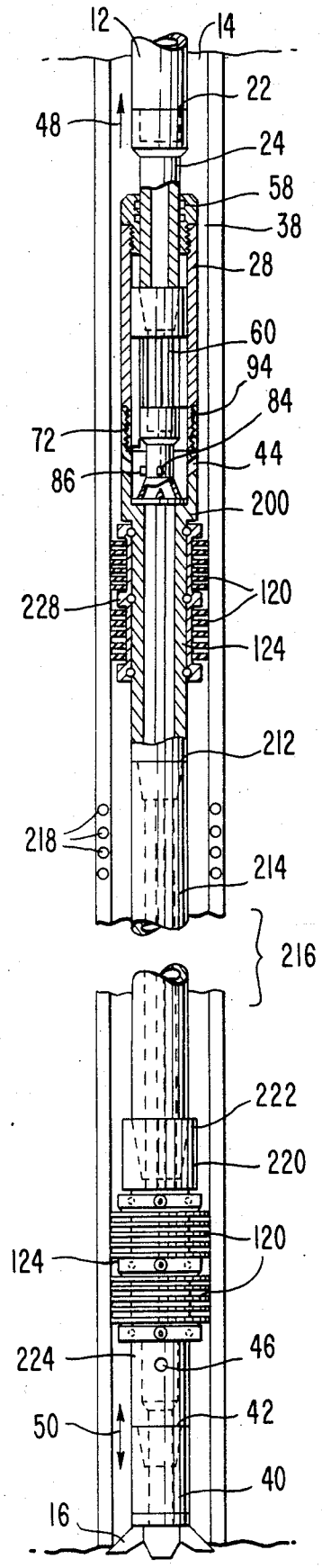
FIG. 18 is an elevational view partly in section illustrating an embodiment of the invention for zoning applications in which the upper and lower portions of the body of the circulation reversing tool is separated by one or more sections of pipe while providing the advantages of a transformable circulation system.

FIG. 18 illustrates an existing borehole having a well borehole 14 and a casing disposed in walls 38. The hollow drill string 12 transmits drilling fluid to the member 24 through connection 22 as in the previous embodiment of the invention. Upper portion 28 may be the same as the upper portion 28 as previously described.

Figure 19:
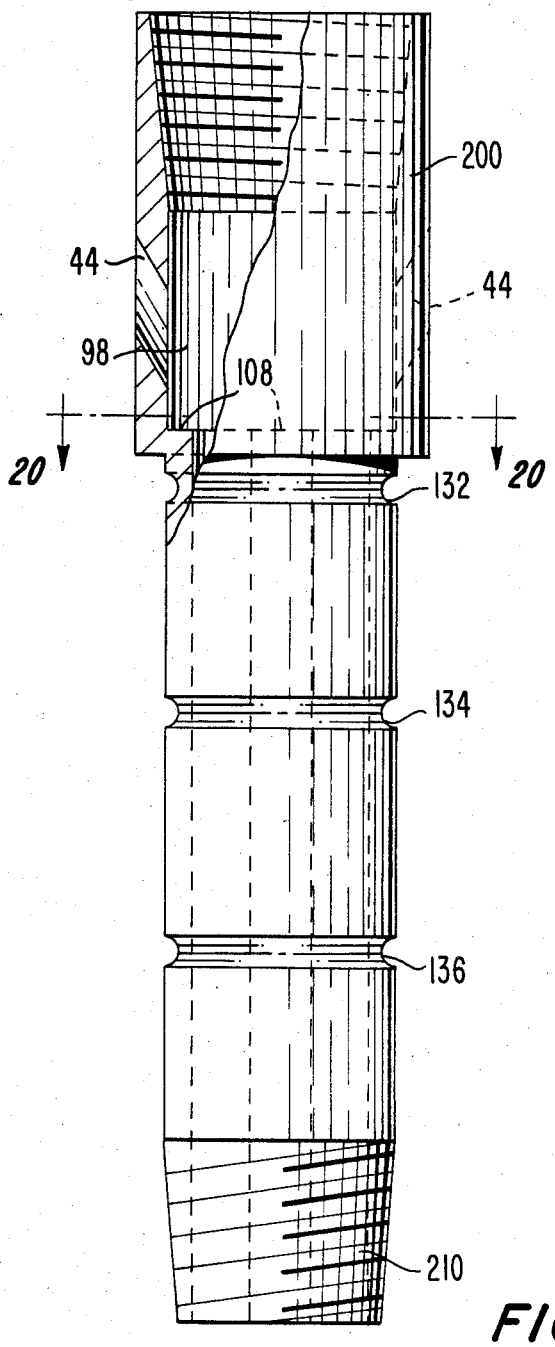
FIG. 19 is an elevational view partly in section of the upper portion of the body of the circulation reversing tool of FIG. 18.
Figure 21:
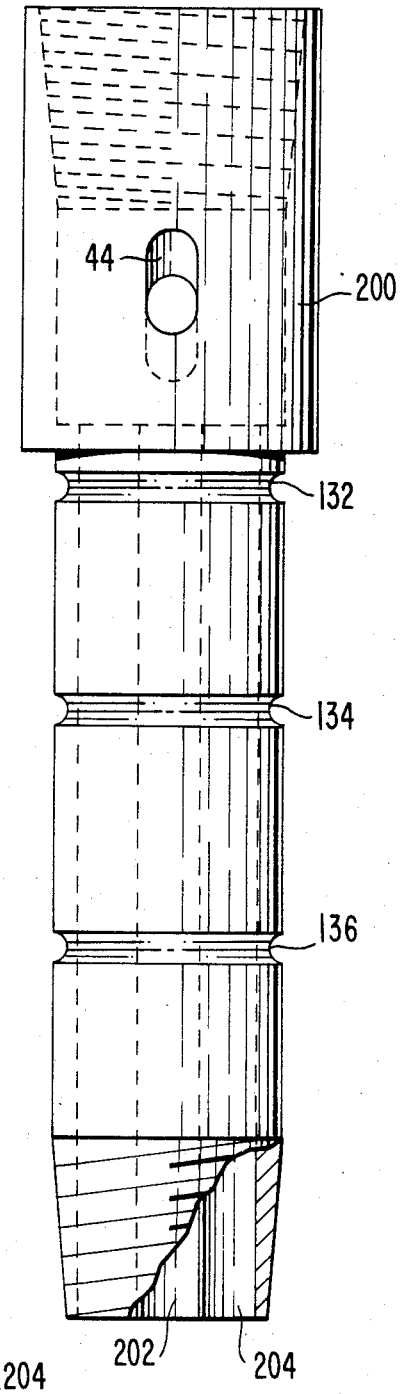
FIG. 21 is an elevational view partly in section of the upper portion of the body of the circulation reversing tool of FIG. 19 turned 90°.
Figure 20:
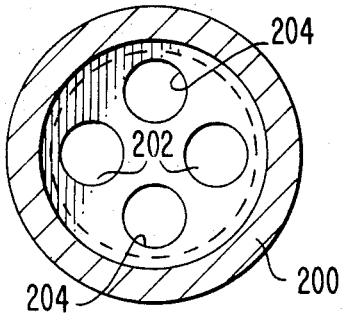
FIG. 20 is a cross sectional view of the upper portion of the body unit taken along the line 20—20 of FIG. 19.
Figure 24:
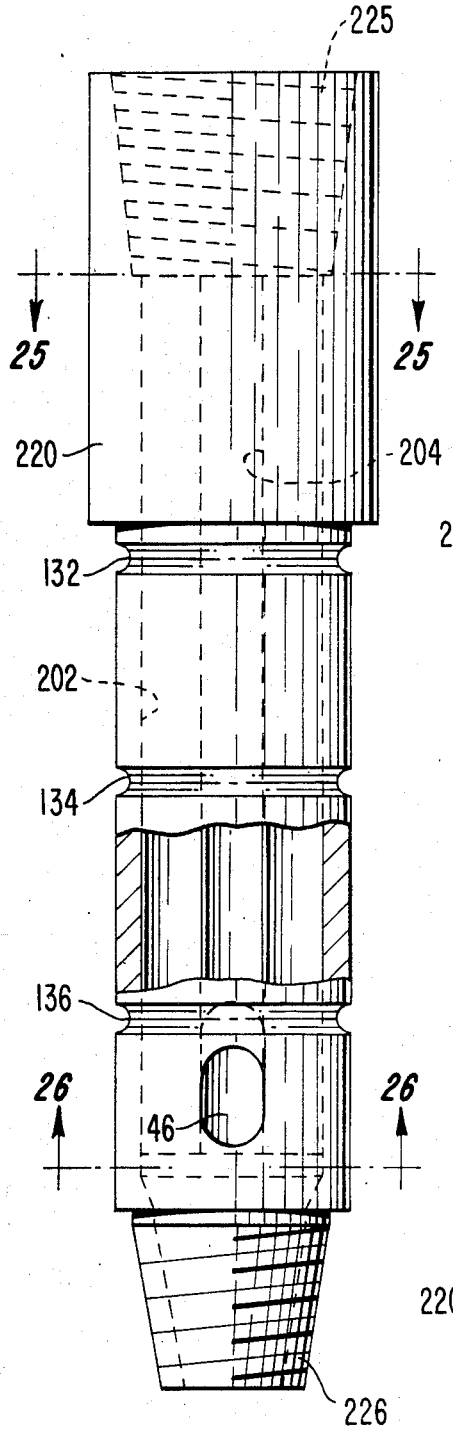
FIG. 24 is an elevational view partly in section of the lower portion of the body of the circulation reversing tool of FIG. 18.
Figure 25:
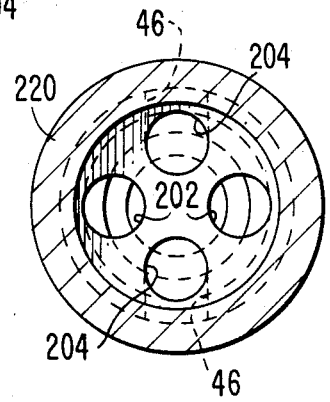
FIG. 25 is a sectional view taken along the line 25—25 of the lower portion of the body of the circulation reversing tool of FIG. 24.
Figure 26:
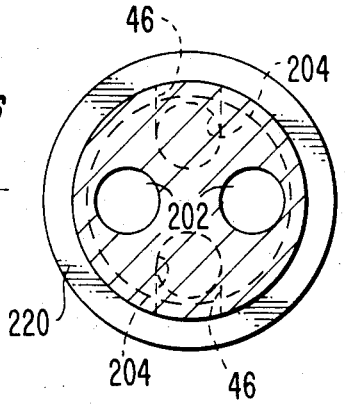
FIG. 26 is a sectional view taken along the line 26—26 of the lower portion of the body of the circulation reversing tool of FIG. 24.
Figure 27:
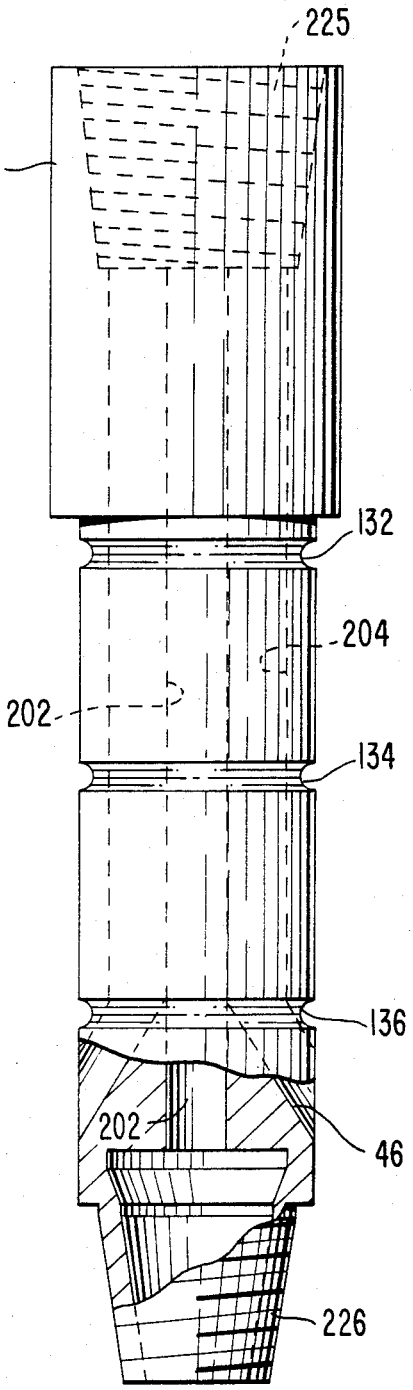
FIG. 27 is an elevational view partly in section of the lower portion of the body of the circulation reversing tool of FIG. 24 turned 90°.

The application of the invention to redrilling existing wells and isolating zones such as perforated producing zones from contamination with drilling fluid may be achieved by modifying the lower portion 30. In FIG. 18 a modified lower portion 200 is connected to threads 94 of upper portion 28. The modified lower portion 200 is illustrated in FIGS. 19, 20 and 21 in which lower portion 200 includes a chamber 98 having a flat confronting surface 108 for accommodating the rotation of the Y-shaped diverter 72. Lower portion 200 however does not include second ports 46 at the lower end. Lower portion 200 instead includes through passages 202 and by-pass passages 204 that axially extend down from chamber 98 to the outlet end of the tool at threaded end 210. Lower portion 200 includes a pair of first ports 44 in chamber 98 like the ports 44 in lower portion 30 as previously described. Lower portion 200 also like lower portion 30 previously described includes three races 132, 134 and 136 for alignment with races 126, 128 and 130 of sleeve 124 including a rubber section 120.

Lower portion 200 is connected at connection 212 to threaded end 210 to corresponding sections of pipe 214 of 4, 5 or 6 foot lengths to by-pass the flow of drilling fluid through the area of casing 216 having production perforations 218. At the lower end of pipe 214 an additional second lower body 220 is joined at connection 222 by threads 225. Second lower body 220 is similar to lower portion 200 except lower body 220 does not include a chamber 98 and does not have a port 44. The two pair of passages 202 and 204 extend downwardly in lower body 220 such that through passages 202 converge into a single channel at threads 226 to transport drilling fluid from the interior drill string into pipe 40 and to the drill bit 16. Through passages 204 connect the two ports 46 to the outside of the lower body 220.

Lower body 220 similarly includes races 132, 134 and 136 for alignment with the races 126, 128 and 130 of sleeve 124 to journal a second seal 224 for sealing off the area of the casing 216 of the drill string from the circulation reversing portion of the drill string.

The two seals 224 and 228 are utilized to isolate one or more sections of perforated production zones in the well to prevent contamination with drilling fluid in producing areas. In the prior art such producing wells and perforated zone had to be cemented and sealed off prior to drilling and subsequently reopened. In accordance with the present invention, seals 224 and 228 can be utilized to isolate one or more of the production zones from drilling fluid while employing the advantages of the circulation reversing tool of the invention.

Figure 22:
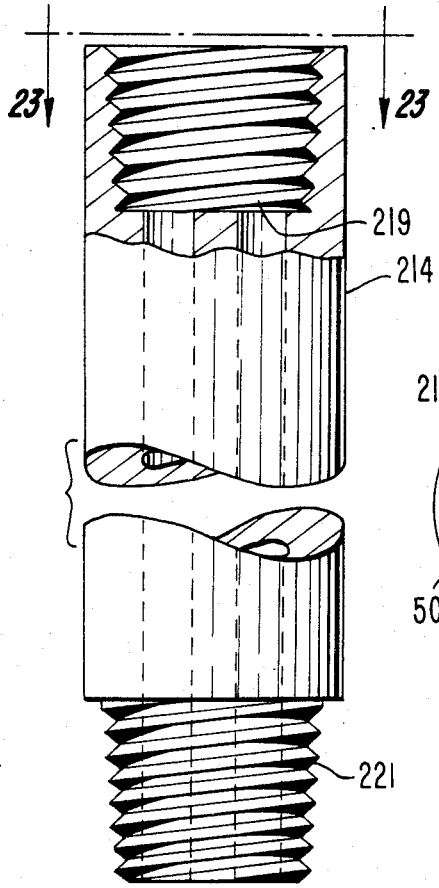
FIG. 22 is an elevational view partly in section of a section of extension pipe as illustrated in FIG. 18.
Figure 23:
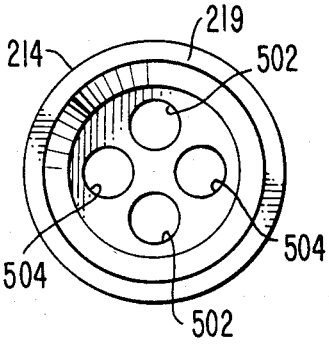
FIG. 23 is a sectional view of the extension pipe taken along the line 23—23 of FIG. 22.
Figure 7:
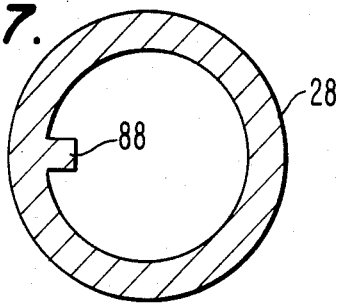
FIG. 7 is a cross sectional view of the upper portion of the body of the circulation reversing tool taken along the line 7—7 of FIG. 6.
Figure 4:
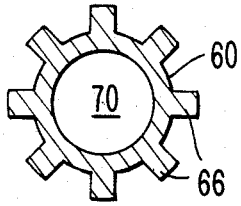
FIG. 4 is a cross sectional view of the circulation reversing tool of FIG. 2 taken along the line 4—4.
Figure 5:
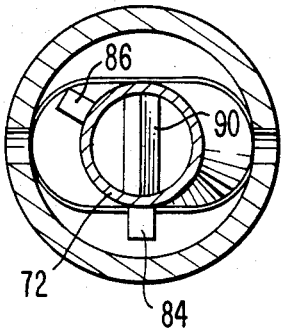
FIG. 5 is a cross sectional view of the circulation reversing tool of FIG. 2 taken along the line 5—5.
Figure 10:
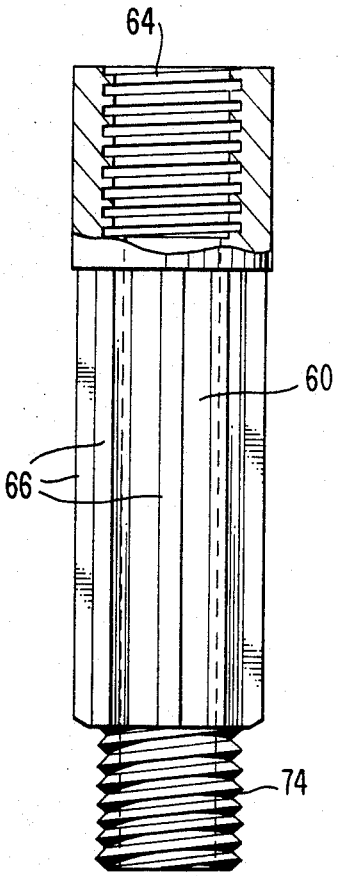
FIG. 10 is an elevational view partly in section of a splined section for engaging and driving the upper portion of the body of the circulation reversing tool.
Figure 11:
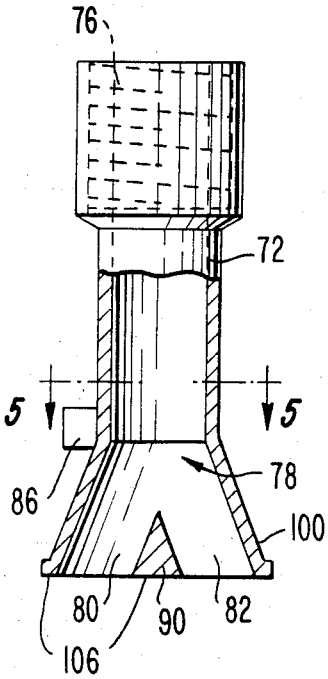
FIG. 11 is an elevational view partly in section of a Y-shaped diverter element.

Sections of pipe 214 connected to lower portion 200 via connection 212 are illustrated in greater detail in FIGS. 22 and 23. Each section of pipe 214 may be in 4, 5 or 6 foot lengths and joined together by internal threads 219 and external threads 221 to provide the requisite length of pipe necessary to by-pass a perforation oil producing zone. Pipe 214 includes two sets of holes 502 and 504 for connecting passages 202 and 204 of lower portion 200 with lower body 220.

The invention may be advantageously employed in a number of drilling operations utilizing conventional and reverse circulation operations and procedures without the necessity of removing the drill string from the borehole annulus. The configuration of the present invention may be modified and adapted in a number of ways to achieve the advantages of the invention. The shape and configuration of the first and second ports 44 and 46 may be disposed at an angle other than 90° to provide the advantages of angularly discharging drilling fluid during the rotation of the drill string. The angular changes may be modified to suit particular requirements. These advantages may be implemented in a number of ways including the utilization of a single or multiple first port and a single or multiple second port.

Figure 28:
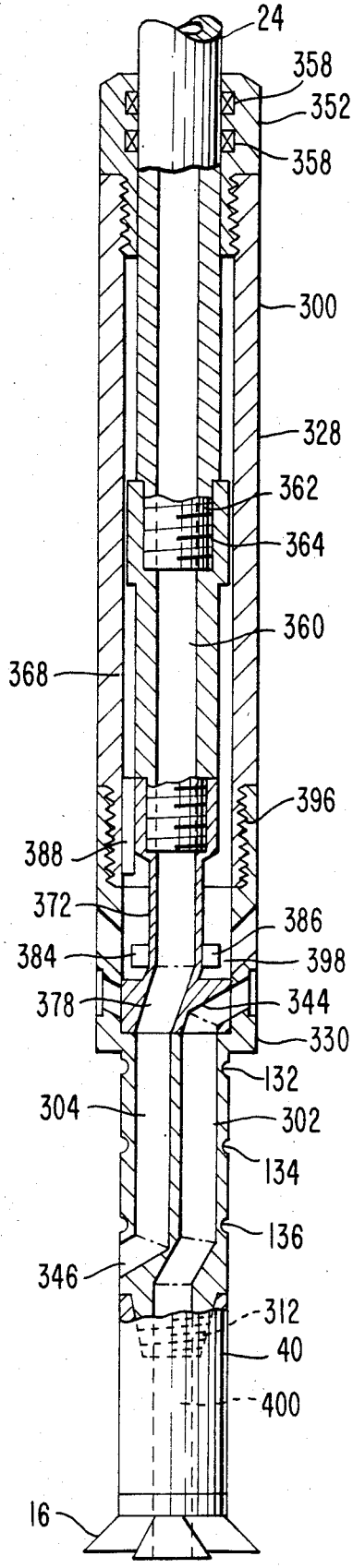
FIG. 28 is an alternative embodiment of the novel circulation reversing tool of the invention having a diverter with a single passage connecting the upper portion of the body with the lower portion of the body having two passages in accordance with the invention.
Figure 12:
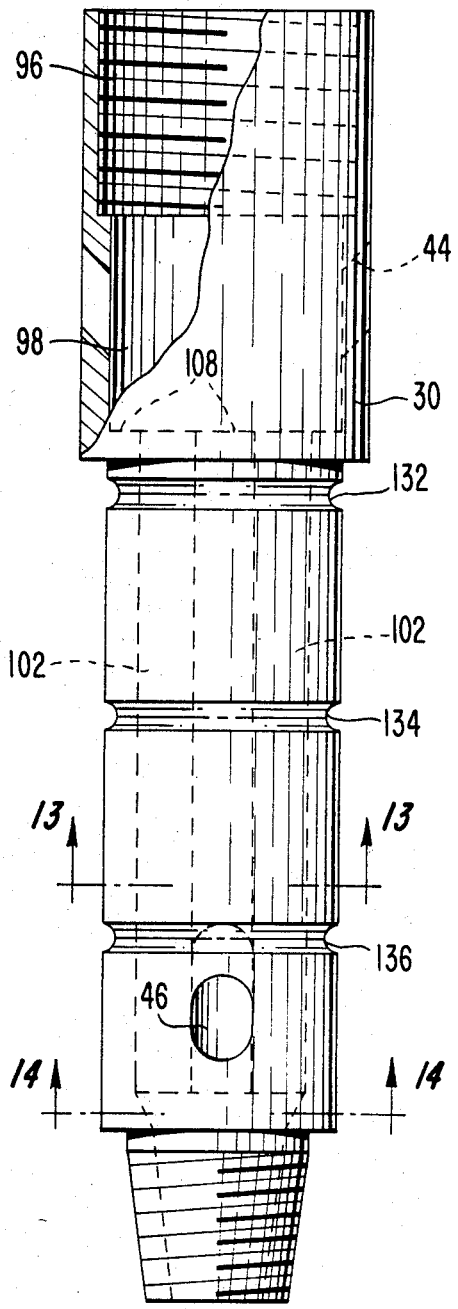
FIG. 12 is an elevational view partly in section of the lower portion of the body of the circulation reversing tool of FIG. 1.
Figure 15:
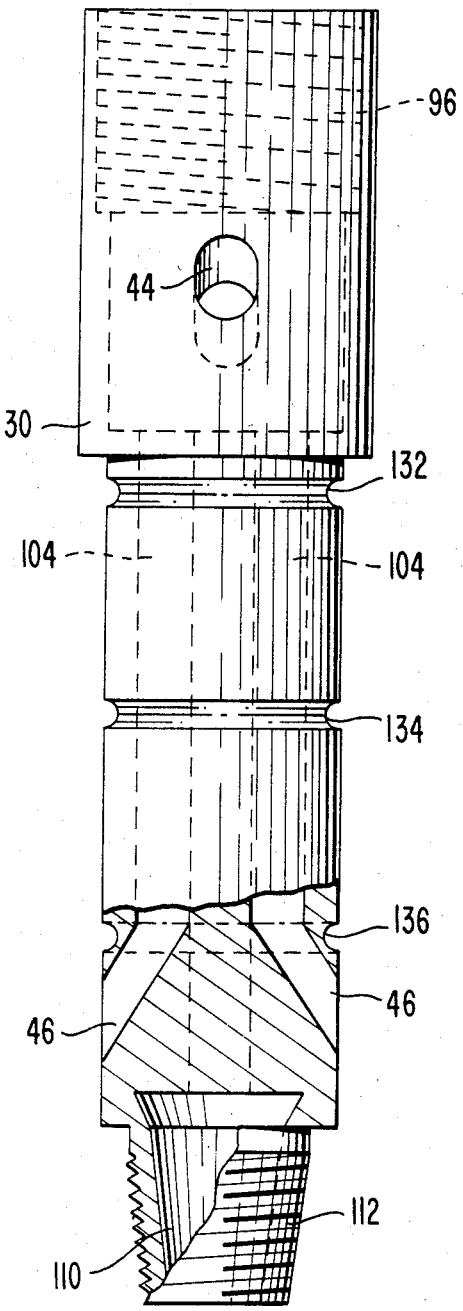
FIG. 15 is an elevational view partly in section of the lower portion of the body of the circulation reversing tool of FIG. 12 turned 90°.
Figure 13:
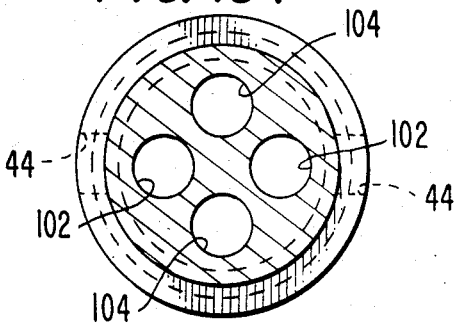
FIG. 13 is a cross sectional view of the lower portion of the body of the circulation reversing tool taken along the line 13—13 of FIG. 12.
Figure 14:
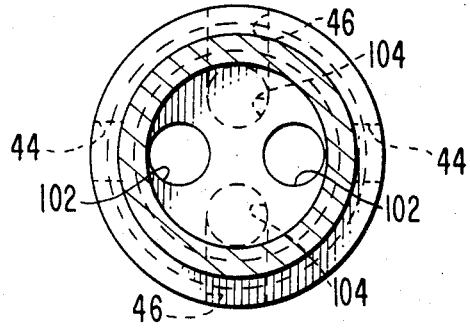
FIG. 14 is a cross sectional view of the lower portion of the body of the circulation reversing tool taken along the line 14—14 of FIG. 12.

The invention may also be implemented by utilizing a diverter with a single channel and a lower body portion with two passages as illustrated in FIG. 28. This alternative embodiment of the invention employs a diverter 372 having a single channel 378 in combination with splines and a key spline as has been previously discussed with respect to the preferred embodiment of the invention. The circulation reversing tool 300 as illustrated in FIG. 28 includes a member 24 rotatably and slideably disposed with respect to an upper portion 328 having a closure 352 including a sealing means 358. Member 24 is connected to a hollow splined section 360 by threads 362 on member 24 and threads 364 in splined section 360. Splined section 360 is designed to engage corresponding internal splines 368 in upper portion 328 which like previous embodiments of the invention includes a key guide 388 for setting the position of the single channelled diverter 372 having stops 384 and 386 disposed thereon for contacting key guide 388 and setting the position of the single channelled diverter with respect to one of the two passages in lower portion 330.

Lower portion 330 is connected to upper portion 328 by threads 396. Lower portion 330 includes a chamber 398 for rotatably accommodating the single channelled diverter 372 in its rotational and axial displacement with respect to passages 302 and 304. The single channel 378 of diverter 372 is designed to engage a single by-pass passage 304 when chamber 398 is connected with through passage 302 and port 344. Alternatively the rotation and connection of channel 378 of diverter 372 with through passage 302 results in second port 344 communicating with by-pass passage 304 through chamber 398.

The connection of channel 378 with by-pass passage 304 as illustrated in FIG. 28 allows reverse circulation of drilling fluid to occur with respect to the nozzles in drill bit 16 by diverting drilling fluid out port 346 below seal 36 attached in races 132, 134 and 136 as has heretofore been described. Seal 36 segments the upper conventional flow portion of the borehole annulus from the lower portion of the borehole annulus in which conversion between conventional circulation and reverse circulation occurs. The embodiment as shown in FIG. 28 allows drilling fluid to be diverted through channel 378 down by-pass passage 304 and exit port 346 to thereafter enter the nozzles in drill bit 16 and be transported up channel 400 in pipe 40 which is connected by threads 312 to lower portion 330. Drilling fluid travelling up through passage 302 enters chamber 398 and exits port 344 and travels up the borehole annulus in the conventional circulation portion of the drill string.

Reverse circulation is returned to conventional circulation with respect to the nozzles in drill bit 16 by raising the drill string to raise member 24 out of engagement with splines 368 and rotating the drill strings in a forward (clockwise) direction to result in the contact and alignment of stop 386 with guide 388. The subsequent lowering of the drill string brings channel 378 into registry with through passage 302 and connects port 344 with by-pass passage 304. Drilling fluid exiting channel 378 of diverter 372 goes down through passage 302 and into channel 400 of pipe 40 to exit the nozzles in drill bit 16 and up the borehole annulus to port 346 and into by-pass passage 304 and chamber 398 to exit port 344 and enter the borehole annulus in the conventional drilling circulation portion of the drill string.

The novel circulation reversing tool of the invention provides numerous advantages over the prior art reverse circulation tools and systems. The advantages of the novel circulation reversing tool allows the change from conventional circulation to reverse circulation at the nozzles of the drill bit without interfering with the conventional circulation system above the tool. The advantages in changing the path of flow of drilling fluid at the nozzles of the drill bit is especially advantageous in milling operations in removing cuttings and chips at the nozzle of the milling tool. These advantages are achieved without the necessity of removing the entire drill string from the borehole annulus or from significantly interrupting the drilling or milling operations since the conversion of the tool occurs while the tool is in the well borehole by the activation from the surface of the geared rotatable diverter that can be rotated either mechanically or electro-mechanically while the bit is in the borehole.

The advantages in reversing flow without removing the bit from the borehole annulus serves to increase drill bit or milling tool life while eliminating costly down time and stacking of drill pipe required in trips to remove the drill string from the borehole annulus. The angular disposition of ports 44 and 46 in combination with the rotation of the drill string and drilling tools serves to assist in the cleaning of borehole walls by directing the flow of drilling fluid against the wall during the rotation of the drill string and the downward travel of the drill string during drilling. These advantages further include the requirement of less hydrostatic pressure at the bottom of the well which serves to increase drill bit life in drilling operations.

The advantages of the novel circulation reversing tool in its broadest application involves a chamber disposed in a body having upper and lower portions in combination with a rotatable member having a diverter mounted in the chamber and a means for positioning the diverter with respect to at least one by-pass passage and at least one through passage. In the preferred embodiment a pair of splines and guide is utilized to position and drive the lower portion of the drill string along with a seal for dividing the drill string into conventional and reversible circulation portions.

In operation, the seal 36 on the novel circulation reversing tool divides the borehole into a conventional flow portion in the upper part of the drill string in which drilling fluid travels down through the center of the drill string and goes up the borehole annulus above seal 36. The portion of the drill string below seal 36 is provided with a convertible circulation flow from conventional circulation.

The combination of the seal with the lower end of the tool and the ability to isolate the conventional flow portion of the drill string from the convertible lower section of the drill string provides numerous advantages and allows the isolation of perforated producing portions of the well without the necessity of cementing, drilling and a subsequent reperforation of oil producing zones. The isolation of producing areas may be achieved by utilizing two seals and adding sections of pipe between the seals to connect the upper portion of the tool with a displaced lower portion of the tool to isolate portions of the well from drilling fluid while providing the advantages of transformable circulation at the nozzles of the milling tool or drill bit.

The novel design of the circulation reversing tool of the invention allows repeated changing from conventional circulation to reverse circulation with respect to the nozzles of the drill bit tool without removing the drill string from the borehole annulus. The utilization of a mechanically activated system provides an effective and inexpensive system for converting from conventional to reverse flow without removing the drill bit. The application of the system to drilling operations serves to increase the operational life of the drill bit and reduce the amount of down time and trips in removing the drill string from the borehole. Moreover, as a consequence of its design and construction the latching mechanism for converting from conventional flow to reverse flow by providing a forward or reverse rotation of the drill string provides advantages in positioning the diverter to provide either conventional or reverse circulation at the nozzles of the drilling tool. It will be appreciated this command from the surface may be modified in connection with the mechanical configuration of the latching mechanism.

As will be recognized by those skilled in the art the present invention has a broad range of applicability and includes a wide range of the modifications that may be employed in the construction of the tool and its implementation. The tool can be formed in sections as heretofore described to assist in its adaptability to various applications in segmenting sections of the borehole annulus into conventional and transformable circulation patterns. The invention may also be implemented in a variety of ways and employ various designs for the ports for changing the pattern and direction of flow at the nozzles of the drill tool while obviating the necessity for removing the entire drill string from the well borehole. It will further be appreciated the tool of the invention may be implemented and modified in a variety of ways to suit particular applications to achieve the advantages of a circulation reversing drilling system. Consequently, it is intended these and other modifications to the tool and applications of the invention to a variety of systems for drilling may be made within the spirit and scope of the invention as defined in the following claims.

What is claimed is:

1. A circulation tool for changing the path of circulation of drilling fluid at the drill bit without removing the drill bit from the borehole annulus comprising:

(a) a substantially hollow cylindrical body having a chamber including a first port disposed intermediate to a first portion having internal splines and a second portion having at least one by-pass passage extending axially from said chamber to a second port and at least one through passage extending from said chamber to the end of said substantially hollow cylindrical body;

(b) a telescoping member having a first end and a second end and a section including splines for engaging said internal splines of said substantially hollow cylindrical body;

(c) a diverter mounted to said second end of said telescoping member;

(d) means for rotatably positioning said diverter with respect to said at least one by-pass passage and said at least one through passage; and (e) a seal rotatably mounted on said substantially hollow cylindrical body and disposed intermediate said first port and said second port.

2. The circulation tool of claim 1 wherein said chamber includes a plurality of first ports.

3. The curculation tool of claim 1 wherein said first port and said second port are disposed on said tool at an angle other than 90 degrees with respect to the axis of the hollow cylindrical body.

4. The circulation tool of claim 1 wherein said means for rotatably positioning said diverter with respect to said at least one by-pass passage and said at least one through passage comprises a key guide and a stop guide cooperating with said internal splines on said substantially hollow cylindrical body and said splines on said telescoping member.

5. The circulation tool of claim 4 wherein said key guide is axially positioned from said internal splines on said cylindrical body and said stop guide is axially positioned with respect to said splines on said telescoping member to align said diverter with said at least one by-pass passage upon counterclockwise rotation of the drill string after disengagement of said internal splines from said splines on said telescoping member and to provide alignment of said diverter with said at least one through passage upon clockwise rotation of said drill string after disengagement of said internal splines from said splines on said telescoping member.

6. The circulation tool of claim 5 wherein said first portion and second portion of said substantially hollow cylindrical body are threadably attached.

7. The circulation tool of claim 6 wherein said means for rotatably positioning said diverter with respect to said two by-pass passages or said two through passages comprises a key guide and a stop guide cooperating with said internal splines on said substantially hollow cylindrical body and said splines on said telescoping member.

8. The circulation tool of claim 7 wherein said key guide is axially positioned from said internal splines and said stop guide is axially positioned with respect to said splines on said telescoping member to align of said Y-shaped diverter with said two by-pass passages upon counterclockwise rotation of said drill string after disengagement of said internal splines from said splines on said telescoping member and to provide alignment of said Y-shaped diverter with said two through passages upon clockwise rotation of said drill string after disengagement of said internal splines from said splines on said telescoping member.

9. The circulation tool of claim 8 wherein said chamber includes a plurality of first ports.

10. The circulation tool of claim 8 wherein said first portion and said second portion of said substantially hollow cylindrical body are threadably attached.

11. The circulation tool of claim 10 wherein said substantially hollow cylindrical body includes a second seal rotatably mounted intermediate said first ports and said second ports on said substantially hollow cylindrical body.

12. The circulation tool 11 wherein at least one section of pipe having a plurality of passageways is threadably disposed between said seal and said second seal.

13. The circulation tool of claim 1 wherein said substantially cylindrical body includes two through passages and two by-pass passages having a second port.

14. The circulation tool of claim 13 wherein said diverter has a Y shape for alternatively engaging said two by-pass passages or said two through passages.

15. A circulation reversing tool comprising:

(a) a substantially hollow cylindrical body having a first protion, a second portion and a chamber including at least one first port disposed intermediate said first portion and said second portion, said second portion having at least one through passage and at least one by-pass passage wherein said through passage connects said chamber with the end of said hollow cylindrical body and said by-pass passage connects said chamber with a second port axially displaced from said chamber;

(b) a member having a first end and a second end mounted in said first portion of said substantially hollow cylindrical body;

(c) a diverter mounted to said second end of said member for alternatively connecting said chamber with said through passage or said by-pass passage; and (d) means for rotating and locking said diverter in alignment with said at least one through passage or said at least one by-pass passage whereby the direction of flow of a drilling fluid in the through passage is reversed when the diverter is aligned with the by-pass passage with respect to the direction of flow when the diverter is aligned with the through passage without removing the drill string from the well borehole.

16. The circulation reversing tool of claim 15 wherein said means for rotating and locking said diverter comprises splines on said cylindrical body and mating splines on said member in combination with a key guide and a pair of stop guides.

17. The circulation reversing tool of claim 16 wherein said stop guides are disposed at about 180° to each other to provide alignment of said diverter with said at least one by-pass passage upon counterclockwise rotation of the drill string after disengagement of said splines and an alignment of said diverter with said at least one through passage upon clockwise rotation of said drill string after disengagement of said splines.

18. The circulation reversing tool of claim 15 wherein said first portion and said second portion of said hollow cylindrical body are threadably interconnected.

19. The circulation reversing tool of claim 18 further comprising a first and second seal rotatably mounted on said substantially hollow cylindrical body intermediate to said first port and said second port on said hollow cylindrical body.

20. The circulation reversing tool of claim 19 wherein at least one section of pipe having at least two passages is threadably disposed between said first rotatably mounted seal and said second rotatably mounted seal.

21. The circulation reversing tool of claim 18 having means for threadably engaging at least one section of pipe having four passages between said rotatably mounted seal and said second rotatably mounted seal.

22. The circulation reversing tool of claim 15 wherein said second portion of said hollow cylindrical body includes two through passages and two by-pass passages having a second port.

23. The circulation reversing tool of claim 22 wherein said diverter is Y shaped for alternatively engaging said two through passages or said two by-pass passages.

24. The circulation reversing tool of claim 23 wherein said means for positioning and locking said diverter comprises splines on said cylindrical body and mating splines on said member in combination with a key guide and a pair of stop guides.

25. The circulation reversing tool of claim 24 wherein said stop guides are displaced at about 90° to each other to provide alignment of said Y shaped diverter with said two through passages upon clockwise rotation of the drill string after disengagement of said splines or an alignment of said Y shaped diverter with said two by-pass passages upon counterclockwise rotation of said drill string after disengagement of said splines.

26. The ciruculation reversing tool of claim 15 further comprising a rotatably mounted seal disposed intermediate said first port and said second port on cylindrical body.

27. A transformable circulation tool for changing the path of drilling fluid at the drill bit without removing the drill string from the borehole comprising;

(a) a substantially hollow cylindrical body having a first portion with internal splines and a second portion having a chamber with a first port and at least one by-pass passage and at least one through passage, said by-pass passage terminating in a second port axially displaced with respect to said first port;

(b) a telescoping member having a first end for threadably engaging drill pipe in a drill string and a second end having splines disposed intermediate said first end and said second end for engaging said internal splines in said substantially hollow cylindrical body;

(c) a diverter mounted to said second end of said telescoping member;

(d) a guide and key combination for alternatively aligning said diverter with respect to said by-pass passage and said through passage; and (e) a seal rotatably mounted on said substantially hollow cylindrical body between said first port and said second port.

28. The transformable circulation tool of claim 27 wherein said first portion and said second portion of said substantially hollow cylindrical body are threadably interconnected.

29. The transformable circulation tool of claim 28 further comprising a second seal rotatably mounted on said substantially hollow cylindrical body between said first port and said second port.

30. The transformable circulation tool of claim 29 including one or more sections of pipe having at least one by-pass passage and at least one through passage disposed between said first portion and said second portion of said substantially hollow cylindrical body.

31. The transformable circulation tool of claim 28 wherein said guide and key combination are disposed with respect to each other so that disengagement of said splines on said telescoping member from said internal splines and a clockwise rotation of the drill pipe results in conventional circulation of drilling fluid at the drill bit and a counterclockwise rotation of said drill pipe results in a reverse circulation of drilling fluid at said drill bit.

32. The transformable circulation tool of claim 31 wherein said body portion of said substantially hollow cylindrical body includes two through passages and two bypass passages each having a second port.

33. The transformable circulation tool of claim 32 wherein said diverter is Y shaped for alternatively engaging either said two through passages or said two by-pass passages.

34. The transformable circulation tool of claim 27 wherein said second portion of said substantially hollow cylindrical body includes at least two by-pass channels and at least two through channels.

* * * * *